US009142338B2

(12) United States Patent
Brendel

(10) Patent No.: US 9,142,338 B2
(45) Date of Patent: Sep. 22, 2015

(54) OIL TRANSFORMER INSULATION MODULE

(71) Applicant: ABB TECHNOLOGY AG, Zürich (CH)

(72) Inventor: Hartmut Brendel, Halle (DE)

(73) Assignee: ABB TECHNOLOGY AG, Zürich (CH)

( * ) Notice: Subject to any disclaimer, the term of this patent is extended or adjusted under 35 U.S.C. 154(b) by 14 days.

(21) Appl. No.: 14/460,027

(22) Filed: Aug. 14, 2014

(65) Prior Publication Data

US 2014/0354387 A1 Dec. 4, 2014

Related U.S. Application Data

(62) Division of application No. 13/274,735, filed on Oct. 17, 2011, now abandoned.

(30) Foreign Application Priority Data

Oct. 15, 2010 (EP) ..... 10187705

(51) Int. Cl.

| | |
|---|---|
| ***H01F 27/10*** | (2006.01) |
| ***H01F 27/08*** | (2006.01) |
| ***H01B 17/34*** | (2006.01) |
| ***H01F 27/32*** | (2006.01) |
| ***H01F 27/12*** | (2006.01) |

(52) U.S. Cl.

CPC ..... *H01B 17/34* (2013.01); *H01F 27/12* (2013.01); *H01F 27/322* (2013.01)

(58) Field of Classification Search

CPC ..... H01F 27/322; H01F 41/122; H01F 27/12; H01F 2038/125

USPC ..... 336/55, 57, 58, 60

See application file for complete search history.

(56) References Cited

U.S. PATENT DOCUMENTS

| | | | | |
|---|---|---|---|---|
| 2,125,138 | A * | 7/1938 | Vogel | 336/57 |
| 2,710,947 | A | 6/1955 | Gaston | |
| 2,844,746 | A | 7/1958 | Coggeshall | |
| 3,071,845 | A | 1/1963 | Leonard et al. | |
| 3,170,134 | A * | 2/1965 | Palmer | 336/205 |
| 3,237,136 | A * | 2/1966 | Ford | 336/205 |
| 3,246,271 | A | 4/1966 | Ford | |
| 3,252,117 | A * | 5/1966 | Fischer | 336/187 |
| 3,302,149 | A | 1/1967 | Forsha | |
| 3,386,060 | A | 5/1968 | Reber | |
| 3,416,110 | A | 12/1968 | Morris et al. | |

(Continued)

OTHER PUBLICATIONS

Office Action issued by the U.S. Patent and Trademark Office in the U.S. Appl. No. 13/272,923, mailed Nov. 13, 2012, U.S. Patent and Trademark Office, Alexandria, VA. (10 pages).

*Primary Examiner* — Elvin G Enad
*Assistant Examiner* — Joselito Baisa
(74) *Attorney, Agent, or Firm* — Buchanan Ingersoll & Rooney PC

(57) ABSTRACT

An exemplary oil transformer insulation module includes at least a first flat layer and a second layer adjacent and substantially and parallel to the first layer. The first and second layers include planar first insulation material and are connected to and spaced apart from a third corrugated layer that is arranged between the first and second layers. The third layer includes planar second insulation material, has lateral edges, and is corrugated such that all the cavities formed by the corrugated form can be flooded with a liquid via the lateral edges.

18 Claims, 3 Drawing Sheets

(56) References Cited

U.S. PATENT DOCUMENTS

| | | | | | |
|---|---|---|---|---|---|
| 3,500,272 | A | * | 3/1970 | Fischer et al. | 336/60 |
| 3,564,470 | A | | 2/1971 | Van Nice | |
| 3,585,276 | A | | 6/1971 | Beckett | |
| 3,713,061 | A | | 1/1973 | Weber | |
| 3,748,616 | A | * | 7/1973 | Weber et al. | 336/60 |
| 4,000,482 | A | * | 12/1976 | Staub et al. | 336/60 |
| 5,598,137 | A | * | 1/1997 | Alber et al. | 336/223 |
| 7,981,841 | B2 | | 7/2011 | Kramer et al. | |
| 2012/0092113 | A1 | | 4/2012 | Brendel et al. | |

* cited by examiner

OIL TRANSFORMER INSULATION MODULE

RELATED APPLICATIONS

This application is a divisional of U.S. patent application Ser. No. 13/274,735 filed Oct. 17, 2011, which claims priority under 35 U.S.C. §119 to European Patent Application No. 10187705.8 filed in Europe on Oct. 15, 2010, the entire contents of which are hereby incorporated by reference in their entirety.

FIELD

The disclosure relates to a transformer, such as an oil transformer insulation module.

BACKGROUND INFORMATION

Known high-voltage transformers or high-voltage inductors having a rated voltage on the high-voltage side of 220 kV or 380 kV, for example, a rated power of >100 MVA, for example, and a weight of 200 t or higher, for insulation and cooling purposes, can be arranged in an oil-filled transformer tank, the oil providing both insulation and improved cooling functions. The distance between the high-voltage transformer and the inner wall of the oil tank is substantially governed by technical insulation aspects, for example, by the distance between one potential-exhibiting region and an earthed or another potential-exhibiting region and the geometrical form of the components to be insulated from one another. Depending on predetermined boundary conditions, however, a minimum insulation clearance can be specified, which causes the oil tank to become unnecessarily large or unavailable.

Therefore, it is known to arrange wall-like insulation barriers, as they are called, in regions that are particularly critical in terms of insulation technology within the oil-filled transformer tank, by means of which insulation barriers the insulating paths that can be loaded only to a limited extent in the oil are subdivided or arranged such that a maximum voltage gradient is not exceeded. This affords the advantage that the oil-filled space between transformer and tank wall can be embodied such that it is not unnecessarily large. Barrier systems of this type can include solid panels of pressboard, which are arranged on a complex holding construction in accordance with the individual specification within the transformer tank.

Known barrier systems of this type can be inflexible and difficult to mount and, with regard to the geometries that can be realized, are ultimately limited to a panel form. As a result, if appropriate, only arrangements that are not optimal in terms of insulation technology can be realized. Furthermore, known barrier systems can be dried under the action of heat in a vacuum before being installed in the transformer. This drying can cause the barrier systems to warp, such that they no longer meet the technical insulation specifications.

SUMMARY

An exemplary oil transformer insulation module is disclosed. The oil transformer insulation module comprising at least a first flat layer and a second layer adjacent and substantially parallel to the first layer, wherein the first and second layers include planar first insulation material; a third layer arranged between the first and second layers, wherein the third layer includes planar second insulation material, has lateral edges, and is corrugated such that all cavities formed by the corrugated form can be flooded with a liquid via the lateral edges, and wherein the first and second layers of insulation material are connected to and spaced apart from the third layer.

An exemplary arrangement of oil transformer insulation modules is disclosed. The oil transformer insulation modules comprising an oil transformer insulation module including: at least a first flat layer and a second layer adjacent and substantially parallel to the first layer, wherein the first and second layers include planar first insulation material; a third layer arranged between the first and second layers, wherein the third layer includes planar second insulation material, has lateral edges, and is corrugated such that all cavities formed by the corrugated form can be flooded with a liquid via the lateral edges, and wherein the first and second layers of insulation material are connected to and spaced apart from the third layer, wherein at least two oil transformer insulation modules each having at least one groove are arranged alongside one another on a groove side, a common groove cavity is formed by grooves adjoining one another, and the at least two oil transformer insulation modules are connected to one another by a further oil transformer insulation module, which is adapted in its form to the common groove cavity and is arranged in the latter.

An exemplary oil transformer is disclosed. The oil transformer comprising an oil tank; and at least one oil transformer insulation module including: at least a first flat layer and a second layer adjacent and substantially parallel to the first layer, wherein the first and second layers include planar first insulation material; a third layer arranged between the first and second layers, wherein the third layer includes planar second insulation material, has lateral edges, and is corrugated such that all cavities formed by the corrugated form can be flooded with a liquid via the lateral edges, and wherein the first and second layers of insulation material are connected to and spaced apart from the third layer.

DESCRIPTION OF THE DRAWINGS

The disclosure, further embodiments and further advantages will be described in greater detail based on the exemplary embodiments illustrated in the drawings.

DETAILED DESCRIPTION

Figure 1:
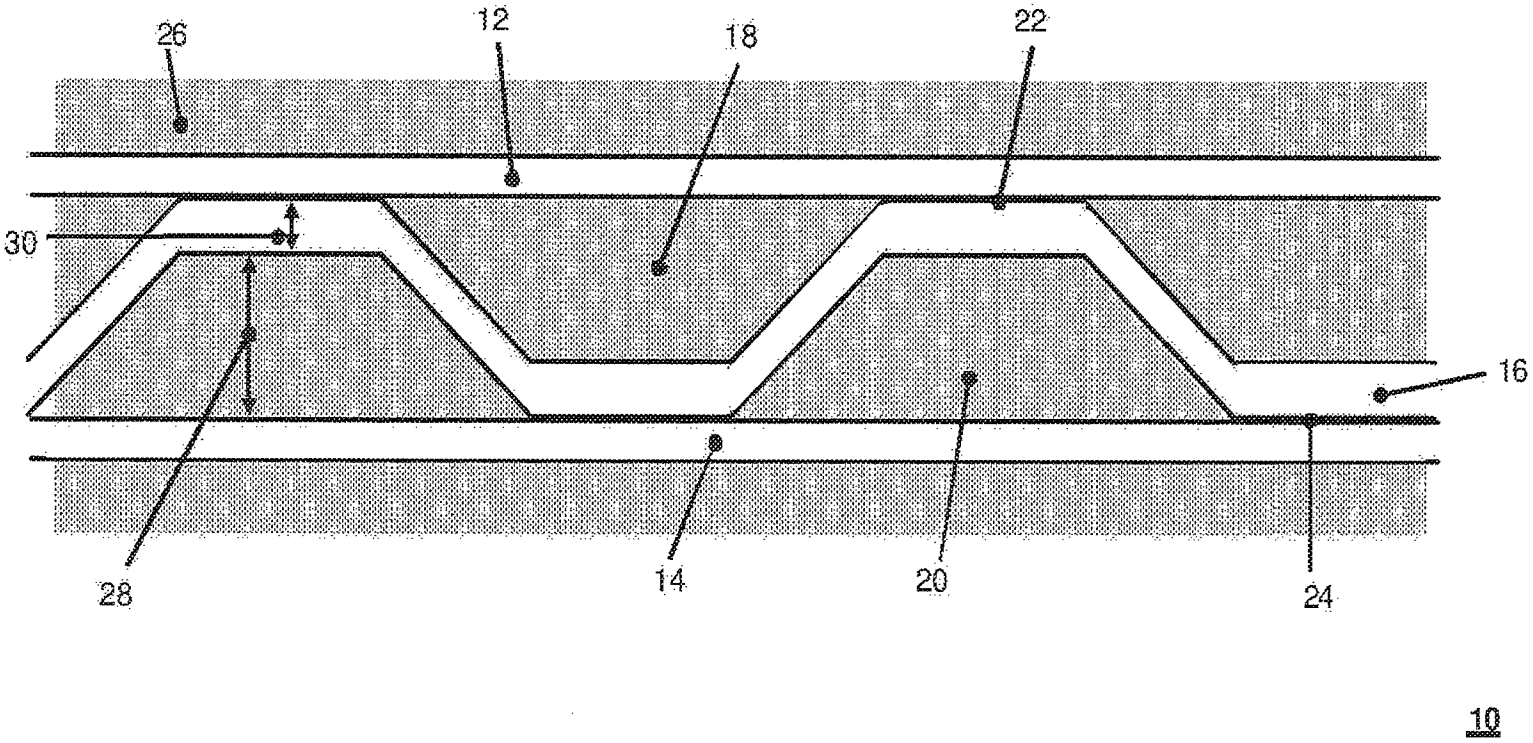
FIG. 1 shows a section through an oil-filled oil transformer insulation module in accordance with an exemplary embodiment of the present disclosure.

Exemplary embodiments of the present disclosure provide oil transformer insulation having an improved insulation capability, which can be flexible in terms of design and dimensionally stable in relation to the drying processes.

An exemplary oil transformer insulation module of the present disclosure can include at least a first flat layer and a second layer adjacent and substantially parallel to the first layer and includes planar first insulation material. The first and second layers of insulation material can be connected to and spaced apart from a third corrugated layer arranged between the first and second layers. The third layer can include a mechanically strong planar second insulation material having lateral edges. The third layer can be corrugated such that all the cavities formed by the corrugated form can be flooded with a liquid via the lateral edges.

Instead of a solid pressboard barrier, exemplary embodiments of the present disclosure can use a barrier having cavities, which can be filled with oil during the operation of the transformer. Each path along a surface normal determining the shortest breakdown path through an oil transformer insulation module formed in this way should not run exclusively in solid insulation material. Rather, as a result of the corrugated form of the third layer, the cavities can be configured such that a part of the path always runs through oil as well. As a result of the different insulation capabilities of oil and solid insulation material such as pressboard in combination with their different dielectric constants and resultant displacements of the electric field, this results in overall a higher insulation capability for the same thickness. In the case of an oil transformer insulation module according to the disclosure, a path running purely through solid insulation material follows in sections the corrugated form of the third layer and is therefore oblique and correspondingly longer relative to the shortest path along a surface normal, such that an improved insulation capability results in this regard as well.

During operation a prerequisite for an insulation capability of an exemplary oil transformer insulation module of the present disclosure of involves the cavities of said oil transformer insulation module being flooded with oil so that air inclusions are avoided. For this purpose, all the cavities should be configured such that they can be flooded at least from one side, and in some instances from two sides. In exemplary embodiments of the present disclosure, other than oil, any suitable liquid insulate can be used as desired. An oil transformer insulation module can be flooded with oil through its open side edges into which the cavities produced by the corrugated third layer open as channels. An oil transformer insulation module should therefore be arranged within an oil tank such that the channels formed by the cavities run in a vertical direction, for example, from the bottom towards the top. In this way, air inclusions still situated in the channels can easily escape upwards when an oil transformer insulation module is immersed in oil. By establishing a vacuum, possible air inclusions can be removed particularly reliably even from horizontally arranged channels formed by cavities.

In order to ensure a mechanical stability of an oil transformer insulation module, a mechanically strong insulation material for forming the three layers should be used. In particular, in the combination with the insulate oil, the insulation material pressboard or another appropriately hard material based on cellulose can be used as desired. As a result of use of the exemplary materials in the composite assembly of the first to third layers, a high mechanical stability of an oil transformer insulation module can result.

Exemplary embodiments of the present disclosure preclude or significantly reduce warpage of an oil transformer insulation module. Thus, a planar insulation barrier with a planar insulation module having a surface area of a few square meters which, along the entire area, is at a constant distance of a few millimeters, for example, 10 mm or 20 mm, from a planar component to be insulated can be constructed. Specifically, variations in the distance arising as a result of possible warpage of the barrier would reduce the insulation ability of the arrangement, even and precisely if the distance thereby becomes greater than the desired distance in places.

In an exemplary embodiment of the present disclosure, the third layer is corrugated in a trapezium-like manner at least in regions. This arrangement can afford an improved planar connection of the plateau of the third corrugated layer formed by the trapezium shape to the adjoining flat first and second layers. The arrangement of the third corrugated layer also has a positive effect on the insulation capability of the oil transformer insulation module. Furthermore, the mechanical stability is advantageously increased by the now approximately straight strut form of the trapezium sides between first and third layers.

In another exemplary embodiment of the present disclosure, at least one further flat layer and one further corrugated layer connected thereto are arranged between the first and second layers, thus resulting in an alternating sequence of flat and corrugated layers. This multilayered structure advantageously increases both the electrical insulation capability and the mechanical stability. In other exemplary embodiments, the number of alternating layers can be twenty or higher, for example, such that given a very small square base area of an oil transformer insulation module having an edge length of 10 cm, for example, and correspondingly many layers, a vertical supporting element having outstanding insulation properties can be formed. Usually, however, an oil transformer insulation module has three or a maximum of five layers and a base area of one square meter or higher, in order to be usable in its actual function as a barrier wall.

In an exemplary embodiment of the present disclosure, the first insulation material corresponds to the second insulation material, apart from the corrugated form. This simplifies the manufacture of an oil transformer insulation module. The differences in the insulation material could be based for example on the thickness thereof, for example, 1 mm to 4 mm, or on the flexibility thereof, pressboard variants being a preferred embodiment in each case.

In yet another exemplary embodiment of the present disclosure, the height of the cavities formed by the corrugated form corresponds to at least double the thickness of the non-corrugated second insulation material, wherein a four- or six-fold thickness can be suitable as well. This ensures that a minimum proportion of each insulation path running along a surface normal through the oil transformer insulation module runs through oil, as a result of which the insulation capability can be advantageously increased and a displacement of the electric field can be minimized on account of the higher permittivity of the pressboard. In this case, the insulation module forms a barrier system, which by virtue of its dimensional stability, even after thermal and vacuum-technological processes, can advantageously bears directly against the component to be insulated.

In an exemplary embodiment of the present disclosure, the cavities or the channels formed by the cavities run parallel to an alignment axis, wherein the insulation module is bent at least in regions about a bending axis parallel thereto. The layer structure of an oil transformer insulation module can allow bent contour sections. An oil transformer insulation module can attain its high mechanical strength only in the layer composite assembly, such that the individual layers should firstly be brought to the desired form before a composite assembly is formed, for example, by a pressing pressure being applied. Another exemplary embodiment of the present disclosure provides for bending of the corrugated third layer parallel to the alignment axis. An exemplary connecting means is a high-voltage-resistant adhesive such as casein, for example. The shaped parts that can thus be produced in a very simple manner that allow each part to adapt its geometry as necessary to the respective technical insulation specifications within an oil transformer. Thus, it can be possible, for example, to manufacture a hollow-cylindrical oil transformer insulation module, which can be positioned, for example, in an outgoing line dome of an oil transformer tank. An insulation module can achieve its desired insulation capability when all the cavities are filled with oil or some other suitable liquid insulate.

In yet another an exemplary embodiment of the present disclosure, at least one lateral edge of a corrugated layer is offset inwardly relative to the adjoining layers, such that a groove is formed. Specifically, said groove can advantageously be utilized in order to produce a connection to the groove of a further oil transformer insulation module and thus to provide a modular component system composed of standard modules.

In an exemplary embodiment of the present disclosure, two oil transformer insulation modules each having at least one groove are arranged alongside one another on the groove side, a common groove cavity being formed by grooves adjoining one another. In this case, the two oil transformer insulation modules are connected to one another by a further oil transformer insulation module, which is adapted in its form to the common groove cavity and is arranged in the latter. Specifically, if a solid insulation element were used as connecting element, this would lead to an insulation weak point of the connected modules at their connection location, because here the technical insulation advantage of the oil-filled cavities would precisely not be realized. The use of an oil transformer insulation module for connecting two further oil transformer insulation modules ensures, however, that a sufficiently high insulation capability is provided even at the connecting location.

In an exemplary modular system of this type, a wide variety of arrangements can advantageously be assembled from geometrical basic modules, for example a plurality of oil transformer insulation modules that are bent at least in sections to form a ring-shaped structure, which then axially enclose for example insulation-technologically critical components of an oil transformer, for example within a dome of an oil tank. In this case, depending on the requirements, either a rather rectangular or else a rather circular structure is conceivable, which can be arranged in a simple manner in a segment-like fashion around a component, which would not be possible in the case of a non-modular ring structure. Ring structures of this type can also be realized from four totally identical segments in a particularly simple manner, which simplifies production. However, any other combination is also conceivable, for example also staircase-like or U-shaped. In the exemplary modular system of the present disclosure sharp edges should be avoided and embodied with a corresponding bending radius, for example 5 cm.

In an exemplary oil transformer of the present disclosure an oil tank and at least one oil transformer insulation module or an arrangement of oil transformer insulation modules can therefore also be manufactured with a somewhat smaller oil tank in a particularly advantageous manner.

FIG. 1 shows a section through an oil-filled oil transformer insulation module in accordance with an exemplary embodiment of the present disclosure. A first flat layer 12 includes a first insulation material can be connected to a third corrugated layer 16 of a second insulation material at a plurality of connection locations, one of which is designated by the reference symbol 22 by way of example. The other side of the third corrugated layer 16 is connected to a second flat layer 14 of a first insulation material at further connection locations 24, such that cavities 18, 20 are formed between the flat layers 12, 14 and the corrugated layer 16. The cavities can be indicated in FIG. 1 as being filled with oil 26. They are open at the lateral edges of the oil transformer insulation module and have a channel-like form. This arrangement ensures that each channel can be flooded with a liquid insulation medium, for example, oil 26, via the lateral edges. Specifically, an oil transformer insulation module can have its full electrical insulation capability only when all the cavities are filled with a corresponding liquid insulation medium and air-filled regions are no longer present. In particular, material variants of pressboard or some other stable cellulose material are suitable as insulation materials, wherein the thickness of a respective first and second layer can be 2 mm to 5 mm, for example, and the thickness of a corrugated third layer can be 10 mm to 20 mm, for example, the latter value being composed of an actual material thickness 30 and a height 28 of a respective cavity 18, 20. A state in which the cavity is not filled with oil, provides a lightweight construction such that a module of this type, in comparison with a solid insulation barrier wall, can be handled, for example, during mounting into an oil tank of an oil transformer to be manufactured.

A trapezium-like form of the corrugated layer 16 can enable a planar contact-connection 22, 24 of the first 12 and second layers 14 to the third layer 16 at the thus flattened areas, which, in comparison with a sinusoidal form of corrugation, on account of the larger contact area, can have a positive effect both on the mechanical stability of the oil transformer insulation module and on the insulation capability thereof. Specifically, the oblique connecting web formed by the trapezium shape runs at a fixedly defined angle towards the first layer 12, rather than—as in the case of a sinusoidal form—at an arbitrarily acute angle, as a result of which the adjoining channel-like cavities 18, 20 in the connection location region would be fashioned correspondingly acutely and can be difficult to fill with oil, both of which adversely affect the insulation ability. The connection location 22, 24 can be realized for example using a suitable high-voltage-resistant adhesive such as casein.

Figure 2:
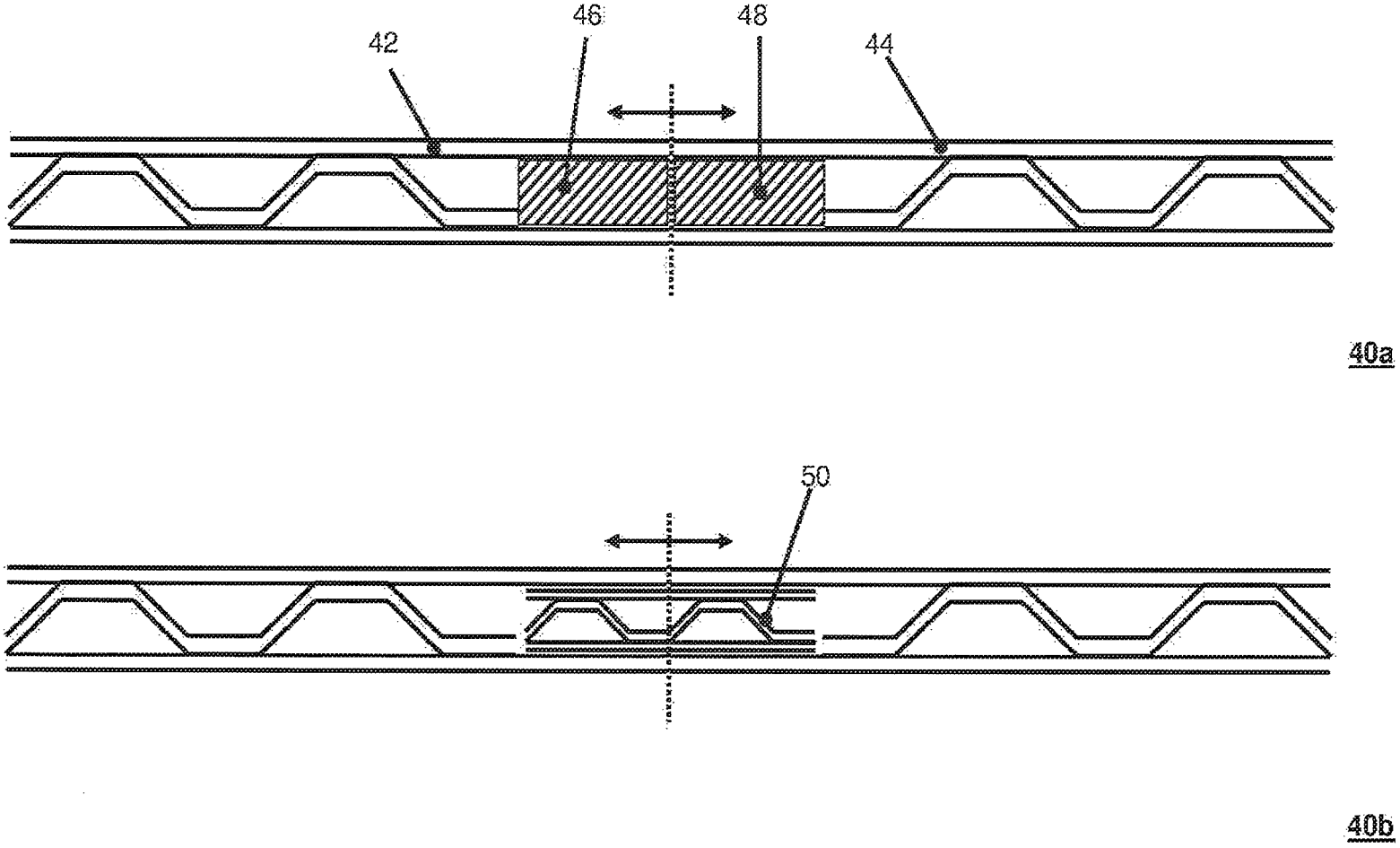
FIG. 2 shows a section through two connected oil transformer insulation modules in accordance with an exemplary embodiment of the present disclosure.

FIG. 2 shows a section through two connected oil transformer insulation modules in accordance with an exemplary embodiment of the present disclosure. As shown in FIG. 2, a section 40*a* through two oil transformer insulation modules 42, 44, which for their part have, at one of their side edges, a groove forming a respective groove cavity 46, 48. In terms of production engineering, the respective groove is realized by offsetting or shortening the corrugated layer inwardly, such that the two outer layers correspondingly project. The two oil transformer insulation modules 42, 44 are arranged alongside one another on the groove side, such that a common groove cavity is formed by the two groove cavities 46, 48, as illustrated in the section 40*a*. The section 40*b* corresponds to the section 40*a*, but here, instead of the groove cavities, at the position thereof, a third oil transformer insulation module is shown, which is arranged in a positively locking manner in the common groove cavity and connects the two other oil transformer insulation modules to one another. The third oil transformer insulation module 50 also has a layer structure according to the disclosure with channel-like cavities, as a result of which it has an improved insulation capability by comparison with a module of corresponding solid design. The situation in which the oil transformer insulation modules connected thereto at the connection location have a reduced insulation capability is therefore advantageously avoided. The depth of a groove should correspond, for example, to two to six times the thickness of the corrugated layer, in order to ensure a mechanically sufficiently stable connection.

Figure 3:
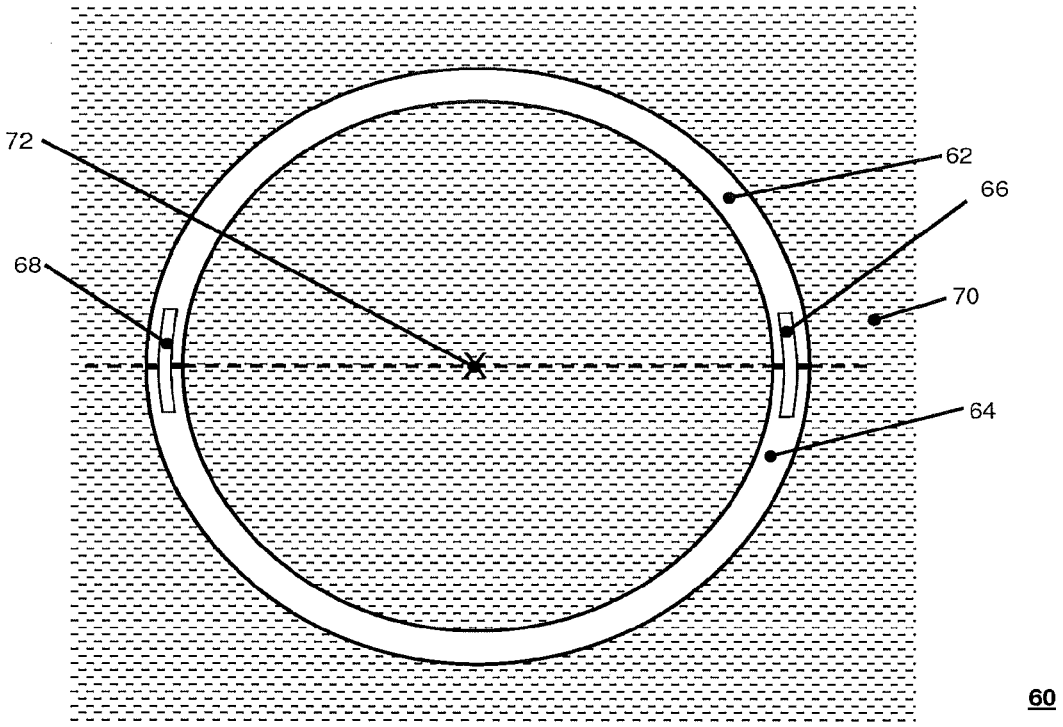
FIG. 3 shows a section through two further connected oil transformer insulation modules in accordance with an exemplary embodiment of the present disclosure.

FIG. 3 shows a section through two further connected oil transformer insulation modules in accordance with an exemplary embodiment of the present disclosure. As shown in FIG. 3, a section 60 through two further connected oil transformer insulation modules 62, 64 arranged in oil 70. These have a respective half-shell-shaped structure and form in the assembled state a hollow-cylindrical element extending about a rotation axis 72. The two oil transformer insulation modules 62, 64 can have a groove at their respective two straight edges and can be arranged relative to one another such that the respective opposite grooves respectively form a common groove cavity. Arranged in these groove cavities are respectively a thinner sixth 66 and a seventh 67 oil transformer insulation module, by which the two further oil transformer insulation modules 62, 64 can be connected in a positively locking manner. It should understood that while a state of the layer structure according to the disclosure in which the cavities are flooded is not illustrated in FIG. 3, oil can be assumed to be present such that the cavities are flooded with oil 70.

The two oil transformer insulation modules 62, 64 can be produced in a correspondingly half-cylinder-like form, in which case firstly each individual layer was brought to the desired form provided with an adhesive in sections and connected to the respectively adjoining layer or layers. The adhesive can be cured under elevated pressure at an elevated temperature, for example in a furnace. As is known in the case of layered composite materials, the composite layers can have extreme strength in conjunction with low weight after the composite has been formed.

Figure 4:
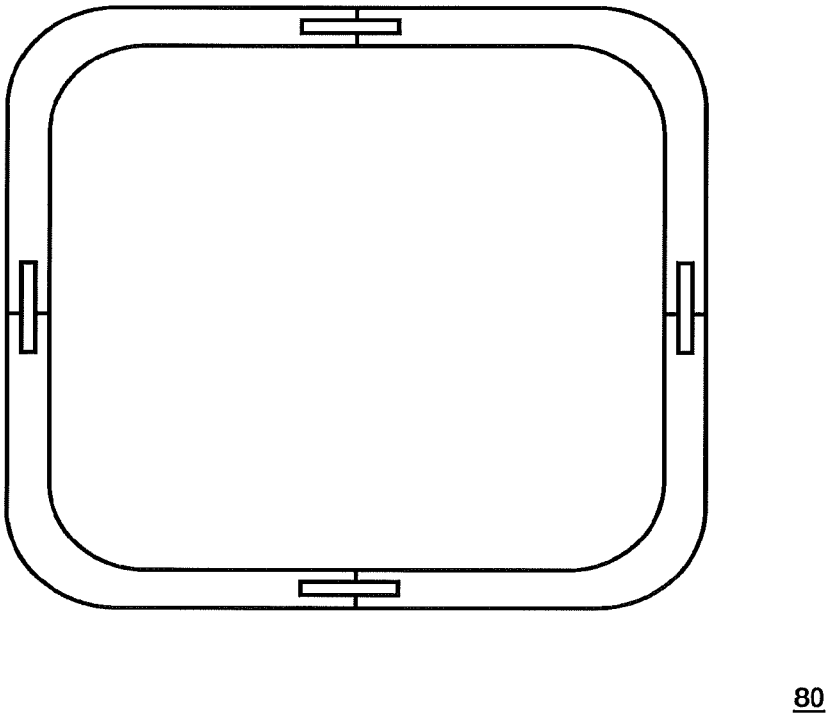
FIG. 4 shows a section through four further connected oil transformer insulation modules in accordance with an exemplary embodiment of the present disclosure.

FIG. 4 shows a section through four further connected oil transformer insulation modules in accordance with an exemplary embodiment of the present disclosure. As shown in FIG. 4, a section through four oil transformer insulation modules of identical type, which are connected to form a rectangular ring structure by means of four further oil transformer insulation modules, here the corners in each case having a bending radius.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Section through an oil-filled oil transformer insulation module
12 First flat layer
14 Second flat layer
16 Third corrugated layer
18 First cavity
20 Second cavity
22 First connection location
24 Second connection location
26 Oil
28 Height of a cavity
30 Thickness of the second insulation material
40*a,b* Section through two connected oil transformer insulation modules
42 First oil transformer insulation module
44 Second oil transformer insulation module
46 First groove cavity
48 Second groove cavity
50 Third oil transformer insulation module
60 Section through two further connected oil transformer insulation modules
62 Fourth oil transformer insulation module
64 Fifth oil transformer insulation module
66 Sixth oil transformer insulation module
68 Seventh oil transformer insulation module
70 Oil
72 Rotation axis
80 Section through four connected oil transformer insulation modules

What is claimed is:

1. An arrangement of oil transformer insulation modules, the arrangement including a first oil transformation module comprising:

at least a first flat layer and a second layer adjacent and substantially parallel to the first layer, wherein the first and second layers include planar first insulation material;

a third layer arranged between the first and second layers, wherein the third layer includes planar second insulation material, has lateral edges, and is corrugated such that all cavities formed by the corrugated form can be flooded with a liquid via the lateral edges, wherein at least one lateral edge of the corrugated third layer is offset inwardly relative to the adjoining layers, such that a first groove with a first groove cavity is formed, the first groove in the corrugated third layer corresponding to a second groove having a second groove cavity formed in at least one other second oil transformer insulation module for joining to the second oil transformer module at the first and second groove cavities, wherein the first and second layers of insulation material are connected to and spaced apart from the third layer, wherein the corrugated third layer is homogenous and has a size corresponding to a respective size of the adjacent first and second layers, and wherein the first groove of the oil transformer module and the second groove of the second oil transformer module are arranged alongside one another on a groove side, a common groove cavity is formed by the first and second grooves adjoining one another, and the first and second oil transformer insulation modules are connected to one another by a third oil transformer insulation module, which is adapted in its form to the common groove cavity and is arranged in the common groove cavity.

2. The arrangement of oil transformer insulation modules according to claim 1, wherein the third layer is corrugated in a trapezium-like manner at least in regions.

3. The arrangement of oil transformer insulation modules according to claim 1, wherein at least one further flat layer and one further corrugated layer connected thereto are arranged between the first and second layers, thus resulting in an alternating sequence of flat and corrugated layers.

4. The arrangement of oil transformer insulation modules according to claim 1, wherein the first insulation material corresponds to the second insulation material.

5. The arrangement of oil transformer insulation modules according to claim 1, wherein a height of the cavities formed by the corrugated form corresponds to at least double a thickness of the second insulation material, which is not corrugated.

6. The arrangement of oil transformer insulation modules according to claim 1, wherein the cavities of the third layer run parallel to an alignment axis and in the insulation module the third layer is bent at least in regions about a bending axis parallel the third layer.

7. The arrangement of oil transformer insulation modules according to claim 6, wherein the first, second, and third layers are connected to one another in a bent state.

8. The arrangement of oil transformer insulation modules according to claim 1, wherein adjacent layers are connected to one another by means of a high-voltage-resistant adhesive.

9. The arrangement of oil transformer insulation modules according to claim 1, wherein all the cavities formed by the corrugated form are flooded with oil.

10. The arrangement of oil transformer insulation modules according to claim 1, wherein a plurality of oil transformer insulation modules bent at least in sections are connected to form a ring-shaped structure.

11. An oil transformer comprising:

the arrangement of oil transformer insulation modules according to claim 1.

12. The oil transformer according to claim 11, wherein the third layer of the at least one oil transformer insulation module is corrugated in a trapezium-like manner at least in regions.

13. The oil transformer insulation module according to claim 11, wherein at least one further flat layer and one further corrugated layer connected thereto are arranged between the first and second layers, thus resulting in an alternating sequence of flat and corrugated layers.

14. The oil transformer according to claim 11, wherein the first insulation material corresponds to the second insulation material.

15. The oil transformer according to claim 11, wherein a height of the cavities formed by the corrugated form corresponds to at least double a thickness of the second insulation material, which is not corrugated.

16. The oil transformer according to claim 11, wherein the cavities of the third layer run parallel to an alignment axis, and in the insulation module the third layer bent at least in regions about a bending axis parallel to the third layer.

17. The oil transformer according to claim 16, wherein the first, second, and third layers are connected to one another in a bent state.

18. The oil transformer according to claim 11, wherein adjacent layers are connected to one another by means of a high-voltage-resistant adhesive.

* * * * *